US005184786A

United States Patent [19]

Brockmanns et al.

[11] Patent Number: 5,184,786

[45] Date of Patent: Feb. 9, 1993

[54] METHOD AND APPARATUS FOR CONTROLLING THE YARN TENSION OF YARN BEING CROSS-WOUND ONTO A BOBBIN ON A TEXTILE WINDING MACHINE

[75] Inventors: Karl-Josef Brockmanns, Willich; Josef Derichs, Monchengladbach; Edmund Wey, Nettetal; Hans Grecksch, Monchengladbach; Leo Tholen, Heinsberg; Manfred Lassmann, Nettetal, all of Fed. Rep. of Germany

[73] Assignee: W. Schlafhorst AG & Co., Moenchengladbach, Fed. Rep. of Germany

[21] Appl. No.: 803,690

[22] Filed: Dec. 3, 1991

Related U.S. Application Data

[63] Continuation-in-part of Ser. No. 507,104, Apr. 9, 1990, abandoned, which is a continuation of Ser. No. 253,975, Oct. 5, 1988, abandoned.

[30] Foreign Application Priority Data

Oct. 5, 1987 [DE] Fed. Rep. of Germany ..... 3733597
Oct. 10, 1987 [DE] Fed. Rep. of Germany ..... 3734395
Apr. 8, 1989 [DE] Fed. Rep. of Germany ..... 3911532

[51] Int. Cl.[5] ..... B65H 59/38

[52] U.S. Cl. ..... 242/45; 242/18 R; 242/35.5 A

[58] Field of Search ..... 242/45, 18 R, 35.5 R, 242/35.5 A, 36, 18 R

[56] References Cited

U.S. PATENT DOCUMENTS 4,685,630 8/1987 Buhren et al. ..... 242/35.5 A
4,768,728 9/1988 Jenny et al. ..... 242/45
4,805,846 2/1989 Ueda et al. ..... 242/18 R

FOREIGN PATENT DOCUMENTS 6608982 1/1972 Fed. Rep. of Germany .

*Primary Examiner*—Stanley N. Gilreath
*Attorney, Agent, or Firm*—Shefte, Pinckney & Sawyer

[57] ABSTRACT

A method and apparatus for controlling the yarn tension of yarn being cross-wound onto a bobbin on a textile winding machine. The amount of yarn on a supply package from which yarn is unwound is determined optoelectronically, gravimetrically or by measuring the yarn tension. The winding speed of the bobbin is adjusted in response to the determined yarn amount of the supply package so as to maintain the yarn tension substantially constant during unwinding. The winding speed of the bobbin can be controlled to follow a predetermined winding speed program which corresponds to the determined mass of the supply bobbin. To determine the yarn amount gravimetrically, the supply package is weighed by a balance device as it is conveyed thereover by a conveyor. The movement of the balance in response to the mass of the supply package can be electronically transmitted to a control device which prepositions a cam having a profile corresponding to the predetermined winding speed program. The rotation of the bobbin is then electronically controlled in response to the movement of a cam follower which follows the cam.

15 Claims, 5 Drawing Sheets

FIG. 1
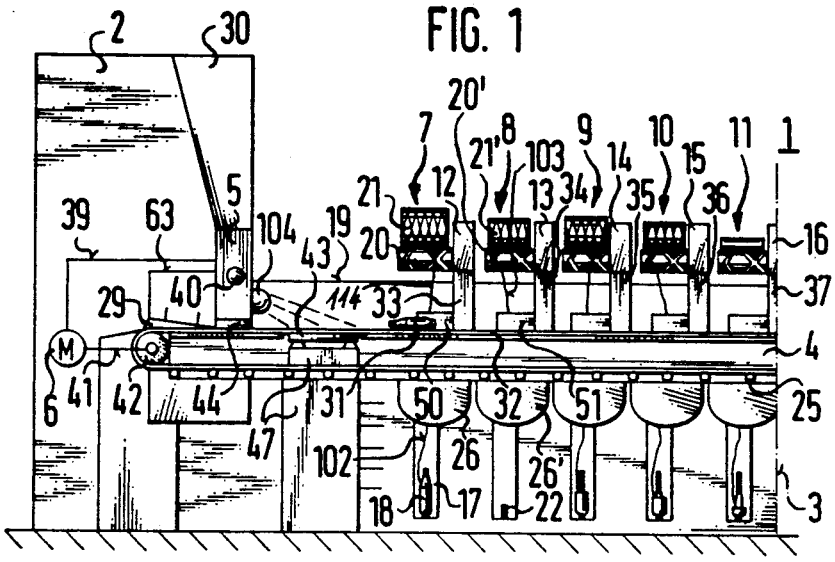
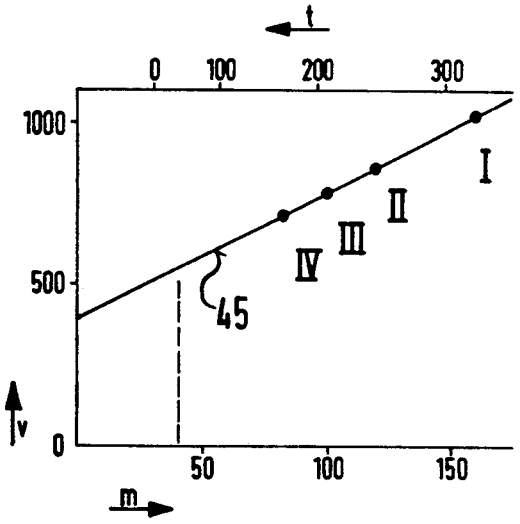
FIG. 2
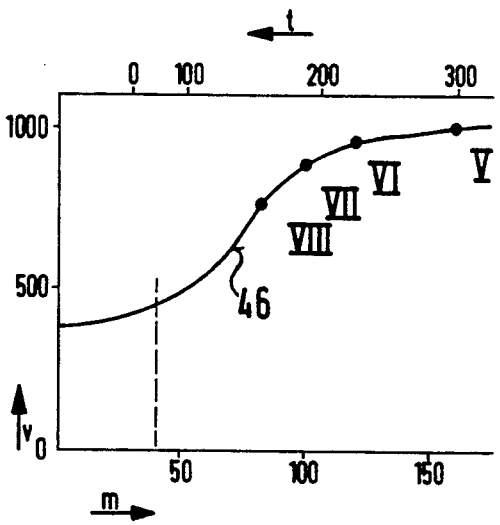
FIG. 3

FIG. 8
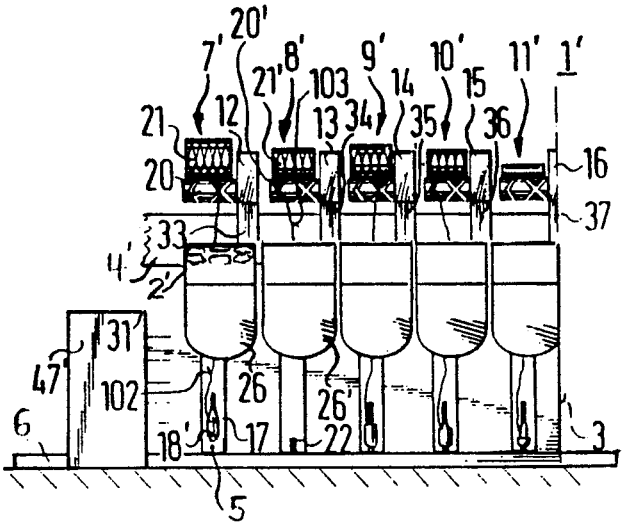
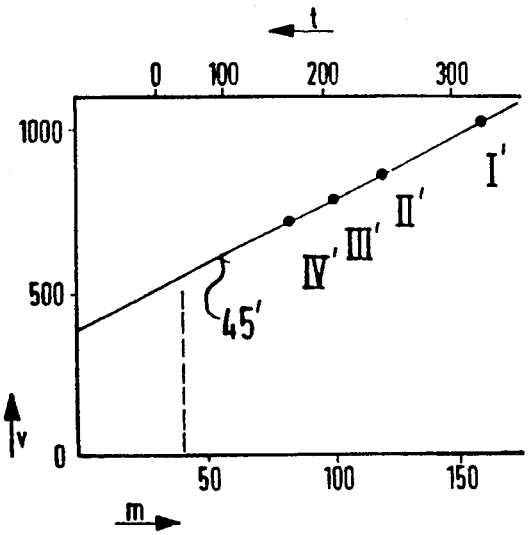
FIG. 9
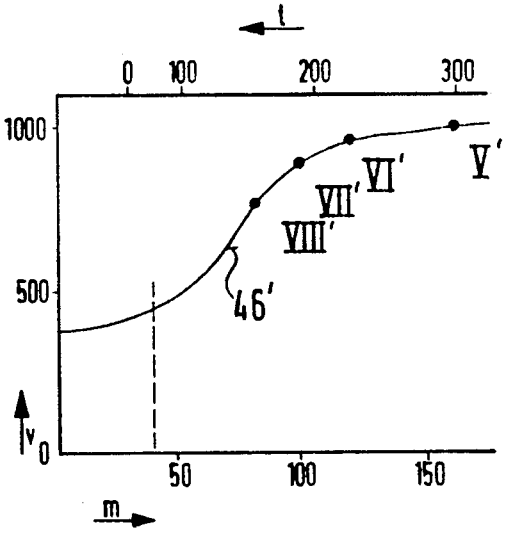
FIG. 10

METHOD AND APPARATUS FOR CONTROLLING THE YARN TENSION OF YARN BEING CROSS-WOUND ONTO A BOBBIN ON A TEXTILE WINDING MACHINE

This is a continuation-in-part of application Ser. No. 07/507,104 filed Apr. 9, 1990, now abandoned, which is a continuation of application Ser. No. 07/253,975 filed Oct. 5, 1988, now abandoned.

BACKGROUND OF THE INVENTION

The present invention relates to a method and apparatus for controlling the yarn tension when cross-winding yarn onto a bobbin on a textile winding machine.

In one type of textile winding process, yarn from supply packages previously delivered to individual winding stations of a textile winding machine is unwound from supply packages and cross-wound onto bobbins in larger packages. If unwound at a constant winding speed, the yarn tension correspondingly increases as the unwinding continues. Frequently, the tensile force on the yarn during the time of unwinding of the last third to fifth of the yarn on the supply package represents the maximum tolerable winding speed. In general, the yarn is capable of handling the load increase resulting from an increase of the draw-off speed during the first 80% of the unwinding time. However, if the tension of the yarn is controlled to a substantially uniform value during the winding, the quality of the yarn on the larger packages can be improved or at least made more uniform. To this end, the winding speed is typically set at approximately that speed at which the maximum tolerable yarn tension occurs.

However, the setting of the winding speed at a predetermined constant value limits the productivity of each winding station since the yarn can, at certain times during the winding operation, be wound at a higher winding speed than the preset speed without the occurrence of yarn tension which exceeds the maximum tolerable tension amount.

SUMMARY OF THE INVENTION

The present invention provides a method and apparatus for controlling the tension of yarn being wound on a textile winding machine at optimum speed and in a manner that provides uniform quality.

Briefly described, the present invention provides a method for controlling the tension of yarn being wound by determining the initial amount of yarn on a supply package prior to unwinding yarn therefrom and controlling the winding speed of the package being wound in response to the determined initial amount of yarn on a supply package and in accordance with a predetermined variation as winding progresses. In one modification of the method of the preferred embodiment of the present invention, controlling the winding speed includes reducing the winding speed in response to reduction in the amount of yarn on the supply package during winding. According to one aspect of the method of the preferred embodiment, determining the amount of yarn includes determining the amount of yarn by optoelectronics or gravimetric sensing, and controlling the winding speed includes controlling the winding speed in response to sensing tension in the yarn being wound so that any tendency for the yarn tension to increase is countered by a reduction in the winding speed causing the tension.

According to another feature of the method of the preferred embodiment of the present invention, the method includes imparting a predetermined initial tension to the yarn being wound and sensing increases in tension due to unwinding and controlling the winding speed responsive to the tension sensing to reduce the winding speed to maintain tension substantially uniform throughout winding. In one aspect of this feature of the method of the preferred embodiment, the predetermined initial tension is the winding tension of the yarn when approximately four-fifths of the yarn has been unwound from the supply package so that a constant high speed unwinding is performed at a constant tension for the first four-fifths of the winding operation followed by a speed reduction to maintain uniform tension.

According to a further feature of the method of the present invention, the method includes applying a predetermined initial additional tension to the yarn being wound and reducing the additional tension applied during winding in an amount substantially equivalent to the increase in tension developing in the yarn due to unwinding from the decreasing amount of yarn on the supply package to maintain a substantially uniform winding tension. In one modification of this feature of the method of the present invention, the additional tension is applied during a first portion of winding during which the winding speed is substantially constant and reducing the winding speed during the remainder of winding to maintain a substantially constant uniform yarn tension.

According to yet another feature of the method of the present invention, the method includes controlling the winding speed of a drive motor at each of a plurality of winding stations of the winding machine according to a predetermined winding speed control program in which the initial speed is determined by the initial amount of yarn determined on the supply package in accordance with the program and reducing the winding speed as winding progresses.

According to one aspect of this feature of the method of the present invention, determining the initial amount of yarn on the supply package is performed while the package is conveyed on a conveyor that delivers supply packages to the individual winding stations. According to another aspect of this feature of the method of the preferred embodiment of the present invention, determining the initial amount of yarn includes optoelectronically or gravimetrically sensing the package on the conveyor.

The present invention also provides an apparatus for controlling the tension of yarn being wound on a textile winding machine. Briefly described, the apparatus includes means for determining the initial amount of yarn on the supply package prior to unwinding yarn therefrom and means for controlling the winding speed of the package being wound in response to the determined initial amount of yarn on the supply package and in accordance with a predetermined variation as winding progresses. Preferably, the means for controlling the winding speed reduces the winding speed in reponse to the reduction in the amount of yarn on the supply package during winding.

In one modification of the preferred embodiment of the apparatus, the means for determining includes optoelectronic or gravimetric sensing means.

Preferably, the controlling means senses the tension in the yarn being wound and controls the winding speed in response to the sensed tension in the yarn being wound.

In another modification of the preferred embodiment of the apparatus, the apparatus includes means for imparting a predetermined initial tension to the yarn being wound and means for sensing increases in tension in the yarn due to the unwinding, the imparting means being operatively connected to the controlling means for controlling the winding speed in response to the sensed tension increases in the yarn to reduce the winding speed to maintain tension substantially uniform throughout winding.

In yet another modification of the preferred embodiment of the apparatus, the apparatus includes means for applying a predetermined initial additional tension to the yarn being wound and means for reducing the additional tension applied during winding in an amount substantially equivalent to the increase in tension developing in the yarn due to unwinding the decreasing amount of yarn on the supply package to maintain a substantially uniform winding tension.

In another form of the apparatus of the present invention, the controlling means includes means for controlling individual drive motors mounted at the respective winding stations of the textile winding machine according to a predetermined winding speed control program in which the initial speed is determined by the initial amount of yarn determined on the supply package in accordance with the program and the winding speed is reduced as winding progresses. Preferably, means for sensing the amount of yarn on a supply package during unwinding is provided at each of the winding stations. In one aspect of this form of the apparatus of the present invention, the controlling means includes a yarn brake for imparting tension to the yarn during unwinding. Moreover, the controlling means of the apparatus includes a first control system operatively connected to the yarn brake for controlling the brake and a second control system for controlling the winding speed of the packages being wound to conform the yarn through a yarn tension profile.

The yarn amount can be determined optoelectronically, gravimetrically or by measuring the yarn tension or the tensile force of the yarn. As the supply package becomes emptier, the yarn tension rises as the draw-off speed remains constant, so that the increase in tension is an indication for the amount of yarn still present.

The present invention provides two closed loop control systems, which provide the capability to act on two actuating mechanisms at the same time or in chronological sequence. The control systems also provide the capability to use the yarn brake only at the time of starting and then to increase the winding speed very rapidly to as high a value as possible, so that the use of the yarn brake becomes superfluous and only the second control system need be used.

A further development of the invention provides drive motors individually controlled according to a preselectable winding speed control program with a winding speed curve in which the winding speed is lowered with the winding time, by which the supply package feed device for the supply package required by a certain winding head, and the particular amount of yarn on the supply package tube, is automatically determined and processed to a yarn amount signal, the starting speed of the winding head is selected which is related to the yarn amount on the winding speed curve which corresponds to the magnitude of the particular yarn amount signal and becomes greater, the larger the yarn amount is.

According to one preferred embodiment of the present invention, the yarn amount is determined at a central location or at the winding station. The yarn amount signal goes to the winding station which receives the supply package. The winding station then sets itself to the starting speed corresponding to the yarn amount. The unwinding time of a full supply package is known in advance for the selected winding speed curve or is determined by an unwinding test. The winding time is longest for a full supply package with the maximum yarn amount. The unwinding of a full supply package begins with a maximum winding speed and ends at a winding speed which is, for example, only half as great as the starting speed. The winding speed curve runs in a linear, stepped or oscillating manner, as desired. The most advantageous curve is determined for the particular yarn. The object thereby is to keep the winding speed as great as possible without undesirable increases in the yarn tension. In many instances, therefore, a convex course of the winding speed curve is the most advantageous. This means that the winding speed decreases slowly at first, then more rapidly at the end of the winding process. The winding speed can, however, potentially also decrease slower at first, then more rapidly and then slower again or tend toward a limit value at the end of the windning process or become constant. It is the most advantageous if the winding speed is inversely proportional to the yarn tension curve. As a result of the adapted winding speed, the yarn tension is controlled to a substantially uniform tension, which evens out the winding density of the cross-wound bobbin and the hairiness of the wound yarn.

The present invention also provides a method and apparatus by which the size of the supply package profile and/or the weight of the supply package is measured and taken as a measure for the yarn amount or for generating the yarn amount signal.

The size of the supply package profile can be detected, e.g., optoelectrically according to the shadow or reflection principle and converted into an electrical signal of a corresponding magnitude. The larger the shadow is, the fuller the supply package is and the winding is started at a speed which is proportionately greater.

The weight of the supply package can be determined by a balance, which can be a conveyor type weigher. It is therefore not necessary that the supply package be stationary during the measuring process. Since the tube weight is known, the yarn weight results from the gross weight minus the tube weight. Since the yarn weight of a full supply package is known for each batch, the correlation of the winding time to the yarn amount and the selection of the suitable starting speed can be rapidly performed without problems.

The present invention provides a method and apparatus by which the yarn tension or tensile force of the yarn can be preset by means of a yarn brake located between the cross-wound bobbin and the supply package to a value which is below the yarn tension or tensile force of the yarn which develops between supply package and yarn brake at a constant winding speed after the unwinding of a maximum of approximately four-fifths of the yarn amount of the supply package, and includes a device which becomes active only after the preset yarn tension or the tensile force of the yarn has been exceeded and which causes the winding device to reduce the winding speed in accordance with the yarn amount of the supply package and in accordance with a preselectable function of the control program of the winding device.

In a further embodiment of the invention the yarn amount measuring device consists of an optoelectric sensor which functions according to the shadow or the reflection principle and/or of a supply package balance. In one preferred embodiment of the present invention, two closed loop control systems provide the capability to simultaneously or sequentially control the braking of the yarn and the winding of the yarn.

The present invention also provides a capability of braking the yarn only at the start of the winding operation, then increasing the winding speed very rapidly to the highest possible value, thus eliminating the need for further braking.

The invention will now be explained and described in more detail with reference to the accompanying drawings and following detailed description of the preferred embodiments.

BRIEF DESCRIPTION OF THE DRAWINGS

FIG. 1 is a front elevational view of a portion of a textile winding machine showing a number of winding stations for cross-winding yarn from supply packages onto bobbins;

FIG. 2 is a graphical representation of one type of yarn tension profile with the winding speed v plotted as the ordinate, the mass m of the supply package plotted as the lower abscissa and the winding time t plotted as the upper abscissa;

FIG. 3 is a graphical representation of another type of yarn tension profile with the winding speed v plotted as the ordinate, the mass m of the supply package plotted as the lower abscissa and the winding time t plotted as the upper abscissa;

FIG. 8 is a front elevational view of a portion of a textile winding machine showing a number of winding stations for cross-winding yarn from supply packages onto bobbins and showing means for handling supply packages designated as unsuitable for winding at a winding station;

FIG. 9 is a graphical representation of one type of yarn tension profile, with the winding speed v plotted as the ordinate, the mass of the supply package plotted as the lower abscissa and the winding time plotted as the upper abscissa; and FIG. 10 is a graphical representation of another type of yarn tension profile with the winding speed v plotted as the ordinate, the mass of the supply package plotted as the lower abscissa and the winding time plotted as the upper abscissa.

DETAILED DESCRIPTION OF THE PREFERRED EMBODIMENTS

Figure 4:
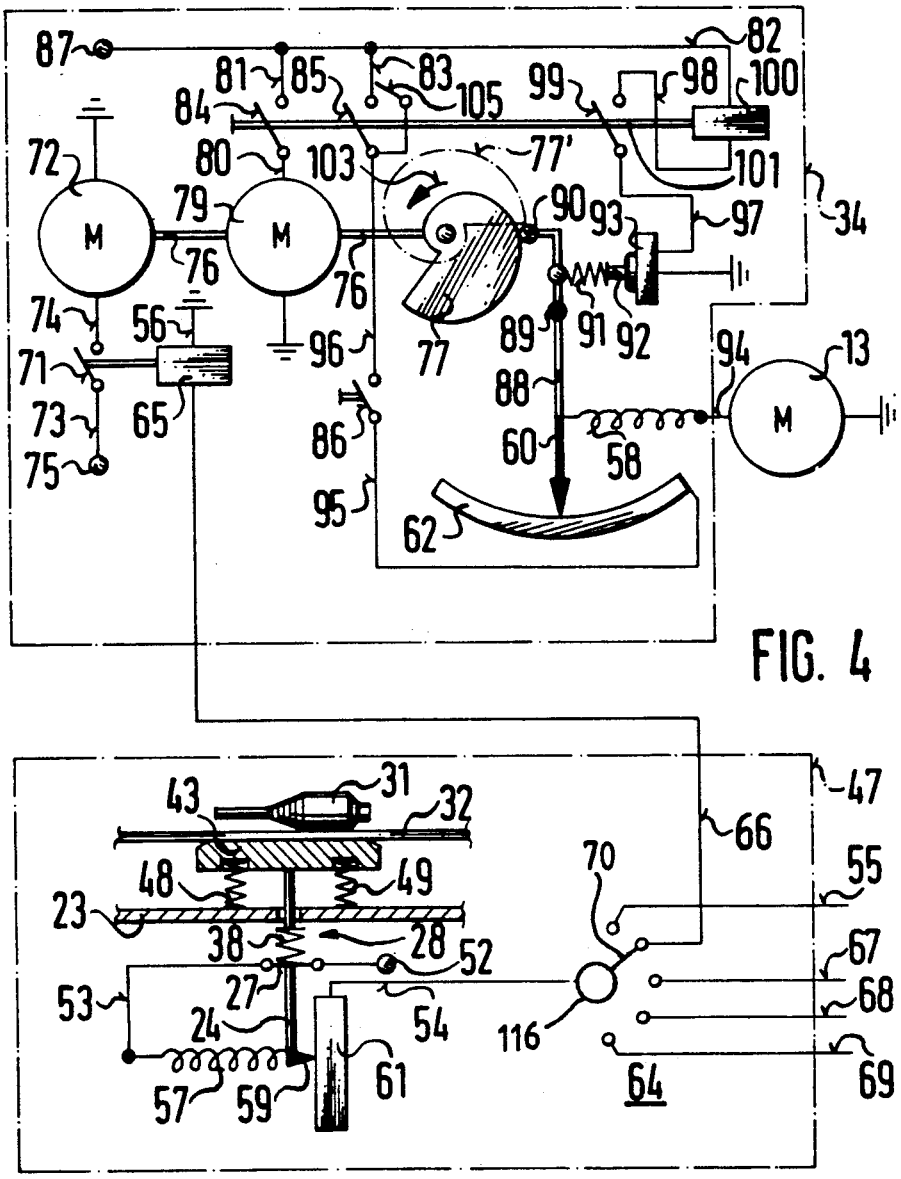
FIG. 4 is a schematic representation of a yarn amount measuring device and a direct motor control device of the method and apparatus of one preferred embodiment of the present invention.

As shown in FIG. 1, an automatic textile winding machine 1 includes end frames, of which the front end frame 2 is illustrated, and a plurality of individual winding stations 7, 8, 9, 10 and 11, which are the winding stations adjacent the front end frame 2. The winding machine 1 has additional winding stations to the right of vertical phantom line 3 which are not illustrated but are identical to the winding stations 7–11. A longitudinal member 4 interconnects the end frame 2 with its oppositely paired end frame (not shown) and supports the cross-winding assemblies of each winding station thereon. Each winding station of the textile winding machine 1 cross-winds yarn from a supply package onto another, larger package.

To illustrate one preferred embodiment of the present invention, the winding station 7 will now be described in detail, it being understood that the winding stations 8–11 are identical in construction to the winding station 7. The winding station 7 includes a receiving area 17 having a vertical spindle 22 vertically mounting a supply package 18 thereon, a winding assembly 20 with reversing thread grooves for cross-winding yarn from the supply package 18 onto a bobbin 21 and a yarn guide unit 26. The winding assembly 20 includes a controllable drive motor 12 for driving the rotation of the bobbin 21; in this respect, the other winding stations 8–11 are each provided with their own individual controllable drive motor 13–16, respectively. Each drive motor 12–16 is operatively connected to a control device 33–37, respectively, at each winding station which controls the motor thereat according to a predetermined winding speed control program.

To deliver the supply packages to the winding stations 7–11, the textile winding machine 1 includes an endless belt-type conveyor 32 extending longitudinally and supported by the longitudinal member 4 along its upper run and on a plurality of belt rollers 25 along its lower run. The belt 32 is driven to the right in FIG. 1 by a belt drive motor 6 which is operatively connected by a drive member 41 to a drive roller 42 around which the belt 32 is trained. A supply package delivery control device 30 mounted on the frame 2 controls the operation of a loader 29, as explained more fully below, which places supply packages, such as the supply package 31 shown in FIG. 1, onto the belt 32 in response to delivery requests from the winding stations 7–11. The supply package delivery control device 30 includes a controller 5, operatively connected to the winding station 7–11 by a collective cable 19, which has an approach sensor 44 for sensing the passage of each supply package 31 past a predetermined position en route to one of the winding stations 7–11. The controller 5 is also operatively connected by a connecting cable 63 to the loader 29. The control device 5 is also operatively connected by a cable 39 to the belt drive motor 6. The controller 5 also includes an optical and acoustical alarm 40 which can be activated to visually and aurally indicate the occurrence of a problem in the delivery of the supply packages.

The winding station 7 includes a diverter 50, the winding station 8 includes a diverter 51 and the other winding stations include identical diverters for unloading a supply package 31 from the belt 32 as the package comes abreast of the respective winding station. The delivery of the supply packages 31 to the winding stations 7–11 is as follows. When one of the winding stations, such as, for example, the winding station 7, has doffed an empty supply package from its receiving area 17 the control device 33 thereat sends a signal via the connecting cable 19 to the controller 5 to request delivery of a new supply package 31. The controller 5 then sends a signal via the cable 63 to the loader 29 to load a supply package 31 onto the belt 32. The controller 5 also signals the belt drive motor 6 to drive the belt 32 once the supply package 31 has been loaded thereon. As the supply package 31 passes by and is sensed by the approach sensor 44, the controller 5 begins a timing operation to control the operation of the diverter 50 at the requesting winding station 7 to unload the supply package 31 as it comes abreast of the winding station. Likewise, if the winding station 8 is the station requesting a new supply package, a supply package 31 is carried by the belt 32 until it is abreast of the diverter 51 whereupon the diverter unloads the supply package from the belt and the supply package drops into the receiving area 17 of the winding station 8 to be vertically mounted on a spindle 22. The controller 5 can sequentially control the delivery of new supply packages to a number of the winding stations by controlling, for example, the loader 29 to load a number of supply packages 31 on the belt 32 at spaced intervals and controlling the respective diverter 50 of each winding station to unload a supply package 31 passing thereby. If desired, the supply packages can be unloaded from the belt 32 in accordance with the chronological sequence of the request signals transmitted the controller 5 by the winding stations.

To gravimetrically determine the amount of yarn on each supply package 31 in accordance with the present invention, reference is now made to FIG. 4 in which a yarn amount measuring device 47 is illustrated and includes a package balance 43 mounted parallel to and immediately below the upper run of the belt 32. The belt 32 moves along the package balance 43 during its upper run. The package balance 43 is supported by a pair of springs 48 and 49 connected to a base support 23, as shown in FIG. 4. The package balance 43 also includes a vertical rod 24 extending downwardly therefrom. One end of a spring 38 is coaxially mounted to the rod 24 and is connected at its other end to a gate 27 of a switch 28. The switch 28 is part of a circuit comprising an electrical voltage source 52 connected to one side of the gate 27, a lead 53 connected to the other side of the gate 27 and extending to a flexible lead 57 and a slide 59 connected to the flexible lead 57 and fixedly mounted to the lower axial end of the rod 24. The circuit continues along a slide resistor 61 with which the slide 59 is in sliding contact to a lead 54 extending from the slide resistor 61 to a connecting bridge 70 which is selectively connectible to a number of other leads described in more detail below.

The connecting bridge 70 selectively connects the slide resistor 61 to one of a plurality of terminals of a selector 64 at which a plurality of leads 55, 66, 67, 68 and 69 terminate. The lead 55 is connected to the control device 33 of the winding station 7, the leads 67, 68 or 69 are respectively connected to the control device 35, 36 and 37 of the winding stations 9, 10 and 11 and the lead 66 is connected to the control device 34 of the winding station 8.

A knob 116 is mounted to the connecting bridge 70 for hand movement of the connecting bridge by an operator to connect the connecting bridge 70 with a selected one of the leads 55, 66, 67, 68, or 69. The connecting bridge 70 is pivotally mounted to the frame of the automatic textile winding machine 1 at its respective end connected to the lead 54. The hand knob 116 pivots the connecting bridge 70 about its pivot connection to selectively connect the other end of the connecting bridge 70 with a selected one of the leads 55 and 66–69.

In operation, an operator manipulates the knob 116 to connect the connecting bridge 70 with the respective lead 55 or 66–69 associated with the particular winding station 7–11 to which the supply package 31 being weighed on the yarn amount measuring device 47 will be conveyed following the weighing operation. The identity of the particular winding station 7–11 requiring a new supply package can be indicated to the operator, for example, by a visual or audio signal produced by the winding station. The video or audio signal can be produced automatically by the winding station requiring a new supply package in correspondence with the discharge of another supply package from the winding station which has been exhausted. Alternatively, an operator can visually determine that a particular one of the winding stations 7–11 requires a new supply package and can accordingly connect the connecting bridge 70 to the respective lead 55 and 66–69 connected to the particular winding station. In the example illustrated in FIG. 4, the connecting bridge 70 has been connected to the lead 66 which is connected to the control device 34 of the winding station 8.

The present invention also contemplates that an appropriate conventional switch means can be operatively connected to the connecting bridge 70 for automatically moving the connecting bridge 70 to the respective lead 55 or 66–69 of the particular winding station requiring the supply package being weighed by the yarn amount measuring device 47. For example, appropriate conventional circuitry can be provided at each winding station, all operative connected to a conventional solenoid assembly having a plunger operatively connected to the connecting bridge 70. The circuitry at the winding station 7–11 would indicate the need for a new supply package at the particular winding station to the solenoid which extends its plunger in response to such signal to move the connecting bridge to the appropriate lead 55 or 66–69.

With further reference now to the control devices of the winding stations, reference is made to the control device 34 of the winding station 8, it being understood that the control devices of the other winding stations are identical. The winding station 8 includes a winding assembly 20′ for cross-winding yarn onto a bobbin 21′ and the winding assembly 20′ includes a rotating member which frictionally engages the yarn wound on the bobbin 21′ to thereby rotate the bobbin. The control device 34 includes a timing relay 65 connected to the lead 66 and having a ground 56. The timing relay 65 opens and closes a switch 71 which bridges a lead 73 running to a voltage source 75 with a lead 74 connected to a high speed motor 72. The high speed motor 72 is fixedly mounted on one axial end of a shaft 76 having a cam 77 fixedly mounted to its other axial end. A motor 79, which operates at a slower speed than the high speed motor 72, can be selectively coupled to the shaft 76 by a conventional clutch (not shown) to thereby rotate the shaft. The motor 79 is connected via a lead 80 to a switch 84 which bridges the lead 80 to a lead 81. The lead 81 is connected to a lead 82 which is connected to an electrical voltage source 87. Another lead 83 is also connected to the lead 82 and is connected via a switch 85 to a lead 96 extending to a switch 86. The switch 86 connects the lead 96 to a lead 95 which is connected to a slide resistor 62.

The switches 84 and 85 are each operatively connected to a plunger 101 of a solenoid 100 which is connected to the electrical voltage source 87. A lead 98 extends from the solenoid 100 to a switch 99 which is operatively connected to the plunger 101 and which connects the lead to a lead 97 extending to a microswitch 93. The microswitch 93 has a plunger 92 having its free axial end connected to a spring 91. The spring 91 is connected to a sensing lever 88 on one side of a pivot 89 which pivotally connects the lever to a frame. A cam following roller 90 is mounted to one end of the lever 88 on the same side of the pivot 89 as the spring 91 and is constrained to follow the profile of the cam 77. On the other side of the pivot 89, a slide 60 cooperating with the slide resistor 62 is mounted to the lever 88 and has a flexible lead 58 extending to a lead 94 which is connected to the drive motor 13 of the winding station 8. The flexible lead 58 is in the form of a traction spring so that it additionally operates as a moment arm on the lever 88 to pivot the lever about the pivot 89 and thereby continuously urge the cam following roller 90 into contact with the profile of the cam 77. The high speed motor 72, the motor 79 and the motor 13 are all connected to a ground.

The operation of the yarn amount measuring device 47 and the control device 34 to control the winding of yarn from a supply package 31 onto the bobbin 21' will now be described. In FIG. 1, the winding station 8 is shown immediately after an empty supply package 18 has been doffed therefrom. The control device 34 of the winding station therefore transmits a signal to the controller 5 via the cable 19 to request the delivery of a new supply package 31. Simultaneously, as the supply package 31 on the belt 32 travels over the package balance 43, the balance moves downward in response to the weight of the supply package against the resistance of the springs 48 and 49. The rod 24 also moves downward and, via the spring 38, closes the gate 27 of the switch 28 to thereby close the circuit between the voltage source 52 and the slide 59. The slide 59, mounted on the end of the rod 24, moves downward with the rod and slides along the slide resistor 61 thereby generating a signal which travels via the lead 54 to the connecting bridge 70. In this example, the connecting bridge 70 is connected to the lead 66 of the winding station 8; in the event that the supply package 31 is to be delivered to one of the other winding stations, the connecting bridge 70 is moved to connect with the respective lead 55 or 67, 68 or 69 of the winding station.

The strength of the current flowing from the slide resistor 61 is proportional to the downward travel of the rod 24 and, thus, to the weight of the supply package 31. The current flows from the slide resistor 61 through the timing relay 65 to the ground 56.

Upon receipt of current, the timing relay 65 closes the switch 71 so that current flows from the voltage source 75 to the high speed motor 72. the length of time which the switch 71 is closed is proportional to the amount of current flowing to the timing relay 65 and the switch is again opened when the current flowing to the timing relay 65 drops below a preselected level. In response to the current flowing to it, the high speed motor 72 rotates the shaft 76 at a constant rate so that the longer the motor 72 receives current, the greater the rotation of the shaft 76. The rotation of the shaft 76 causes the cam 77 attached thereto to rotate therewith and, in the example described, the cam is rotated out of its initial position 77' shown in dotted lines to the position shown in the solid lines in FIG. 4. The profile of the cam 77 corresponds to a winding speed profile of bobbin 21', which is described in more detail below.

The solid line position of the cam 77 corresponds to the initial winding speed at which the motor 13 will drive the bobbin 21'. The bobbin 21' is now ready to be rotated at the predetermined initial winding speed to wind yarn from the supply package 31 once the package is delivered to the winding station 8. The supply package 31, after passing over the balance 43, continues its travel to a position abreast of the diverter 51 of the winding station 8 which thereupon diverts the supply package from the belt 32 into the receiving area 17 in which the supply package slides onto the spindle 22. The end of the yarn of the supply package 31 (now designated as 18) is then located and engaged by a yarn guide unit 26' of the winding station 22. With reference to winding station 7, the yarn 102 of the supply package 18 is then pieced by the yarn guide unit 26 to the yarn end 114 of the bobbin 21. Similarly, the yarn guide unit 26' of the winding station 8 pieces the yarn end of the supply package 18 to the yarn end 103 of the bobbin 21'. Once the piecing of the yarn end of the new supply package 18 is accomplished, a signal from the yarn guide unit 26' to a means (not shown) for closing the switch 86 is transmitted. Also, the yarn guide unit 26' sends a signal to the solenoid 100 to retract its plunger 101 and thereby simultaneously close the switches 84, 85 and 99. Now, current from the voltage source 87 can flow through the closed switch 84 to the motor 79 which rotates the shaft 76, via the coupling assembly, to thereby rotate the cam 77 in the direction of the arrow 103. The solenoid 100 continues to receive current from the voltage source 87 and keeps the switches 84 and 85 in their closed positions until the cam 77 has completed its rotation, whereupon the lever 88 pivots to such a degree as to actuate the microswitch 93, which then opens to interrupt the circuit of the solenoid 100. The solenoid 100 extends its plunger 101 at that time, thereby opening the switches 84, 85 and 99.

When the switches 84 and 85 are closed, the drive motor 13 receives current from the voltage source 87 via the slide resistor 62 in an amount corresponding to the resistance generated by the movement of the slide 60 along the slide resistor. As the slide 60 moves along the slide resistor 62, the resistance of the slide resistor 62 increases, thereby decreasing the amount of current flowing to the motor 13 and causing a corresponding decrease in the speed of the motor. The motor 13 operates for a period of time sufficient to rotate the bobbin 21' so that the yarn is completely unwound from the supply package 18 and is cross-wound onto the bobbin 21'. As the trailing end of the yarn from the supply package 18 passes through the yarn guide unit 26', a yarn monitor therein opens switch 86, thereby interrupting the flow of current from the voltage source 87 to motor 13. The motor 13 then stops. Meanwhile, the motor 79 continues to receive current from the voltage source 87 until the microswitch 93 opens the switch 99 to cause retraction of the plunger 101 and, thus, opening of the switch 84.

With reference now to the manner in which the profile of the cam 77 is constructed, FIGS. 2 and 3 graphically illustrate the relationship between the winding speed v of the bobbin 21 or 21' and the mass m of the supply package 31. In each graph, the winding speed v is plotted on the ordinate in units of meters per minute and the mass m is plotted on the lower abscissa in units of grams. Additionally, the time t of the winding is plotted in units of seconds on the upper abscissa. In FIG. 2, a linear winding speed curve 45 extends from 400 meters per minute to 1,100 meters per minute. Four predetermined starting speeds I–IV are plotted on the winding speed curve 45 and correspond to supply package masses of 160, 120, 100 and 80 grams, respectively. Assuming that the bobbin of each supply package 31 has a mass of 40 grams, the starting speeds I–IV correspond to yarn weights of 120, 80, 60 and 40 grams, respectively, and the corresponding predetermined starting speeds are 1,000, 850, 775 and 700 meters per minute. To insure that the supply package 31 is completely unwound, the initial start time can be chosen at a point on the winding speed curve 45 corresponding to a mass less than the mass of an empty bobbin of a supply package. For example, the starting time can be set at a point corresponding to the weight of 30 grams; that is, at 10 grams less than the mass of the spindle of the package itself with no yarn thereon of 40 grams. The winding time will thus continue 10 seconds beyond that point in time in which the supply package has been completely unwound. The profile of the cam 77 is therefore constructed to control the speed of the motor 13 in correspondence with the winding speed curve 45.

Figure 5:
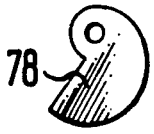
FIG. 5 is a front elevational view of a tension control cam of the method and apparatus of one preferred embodiment of the present invention.

In FIG. 3, a winding speed curve 46 shows the change of winding speed in a non-linear manner. Here, the four predetermined starting speeds V–VIII correspond to supply package masses 160, 120, 100 and 80 grams, respectively. If it is desired to control the speed of the motor 13 so that the winding conforms to the winding speed curve 46, a cam 78 shown in FIG. 5, can be substituted for the cam 77. In the example illustrated, it is assumed that the maximum possible supply package mass is 170 grams and that the spindle of the supply package has a mass of 40 grams. Additionally, a maximum winding time of 350 seconds is set. Thus, in the example shown, if the supply package 31 has a mass of 100 grams, the starting speed III would be selected corresponding to a starting speed of approximately 780 meters per minute and in this instance, the winding time would be approximately 210 seconds. On the other hand, if the cam 78 were substituted for the cam 77, the starting speed corresponding to a supply package mass of 100 grams would be the starting speed VII of 940 meters per minute.

The selector 64 can be set manually or automatically to the respective lead 55, 66, 67, 68 or 69 of a selected winding station by manual or automatic actuation of the connecting bridge 70 to connect the lead 54 to the respective lead. The switch 86 can be moved from open to closed position and reversed by a yarn clearer (not shown) or manually.

Figure 6:
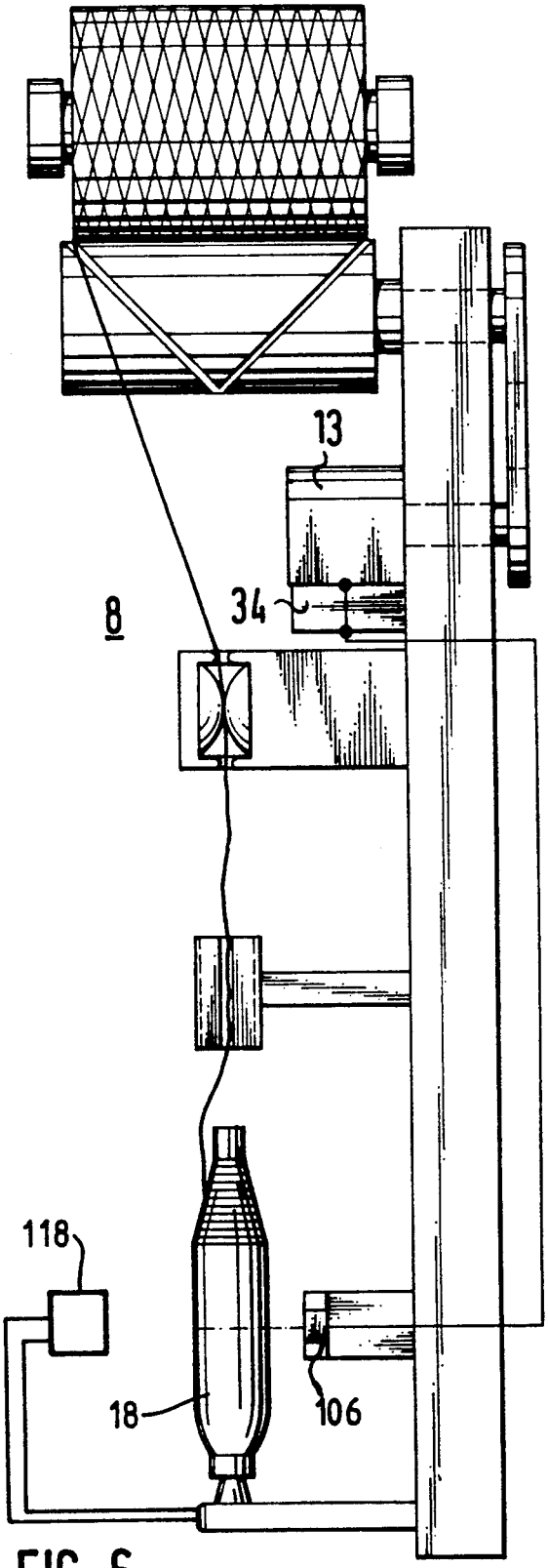
FIG. 6 is a front elevational view of the yarn amount measuring device of the method and apparatus of one preferred embodiment of the present invention.

Another embodiment of the present invention is illustrated in FIG. 6 and includes an optoelectric sensor 106 which can be mounted in the receiving area 17 of a winding station such as, for example, the winding station 8. The optoelectric sensor 106 optically monitors the unwinding of the yarn from a supply package 18 positioned adjacent thereto and generates a signal when the amount of yarn has dropped below a predetermined level, such as, for example, a level at which one third or one-fifth or less of the yarn originally on the supply package remains. The signal generated by the optoelectric sensor 106 is transmitted to the control device 34 which can then correspondingly control the operation of the drive motor 13 to reduce the winding speed.

The optoelectric sensor 106 is mounted at a location relative to the supply package 18 supported in an upright disposition at the winding station for optically monitoring the extent to which yarn has been unwound from the supply package. In this regard, the optoelectric sensor 106 includes a beam emitting component which emits a beam transversely to the axis of the supply package 18 and directed at the body of yarn built on the supply package 18 at a predetermined radial spacing from the axis of the supply package. The radial spacing or offset of the beam emitted by the optoelectric sensor 106 is at a spacing selected to be less than the radial spacing of the outer layer of yarn built on a supply package yet greater than the radius of the tube of the supply package. For example, as noted above, the optoelectric sensor 106 can be configured to generate a signal when the level of yarn is less than one-third or one-fifth of the amount of yarn originally built on a supply package. The optoelectric sensor 106 is an example of an alternative device which can be used in lieu of the yarn amount measuring device 47 to control the winding of yarn of a supply package. In contrast to the gravimetrically-based operation of the yarn amount measuring device 47, the optoelectric sensor 106 does not detect the initial amount of yarn built on a supply package. Instead, the optoelectric sensor 106 provides a signal in correspondence with the unwinding of a predetermined amount of yarn from a supply package. For example, the optoelectric sensor 106 can include a light beam detector 118 positioned relative to the supply package 18 and the light beam emitting component of the optoelectric sensor for sensing the presence of the light beam and providing a signal in response thereto. The yarn on the supply package 18 prevents the transmission of the light beam therepast until the predetermined amount of yarn has been unwound from the supply package and the light beam detector 118, which is preferably positioned oppositely the light beam emitting component of the optoelectric sensor 106 with the supply package 18 intermediate the light beam emitting component and light beam detector, provides a signal once the light beam is no longer obstructed by the yarn on the supply package 18.

Figure 7:
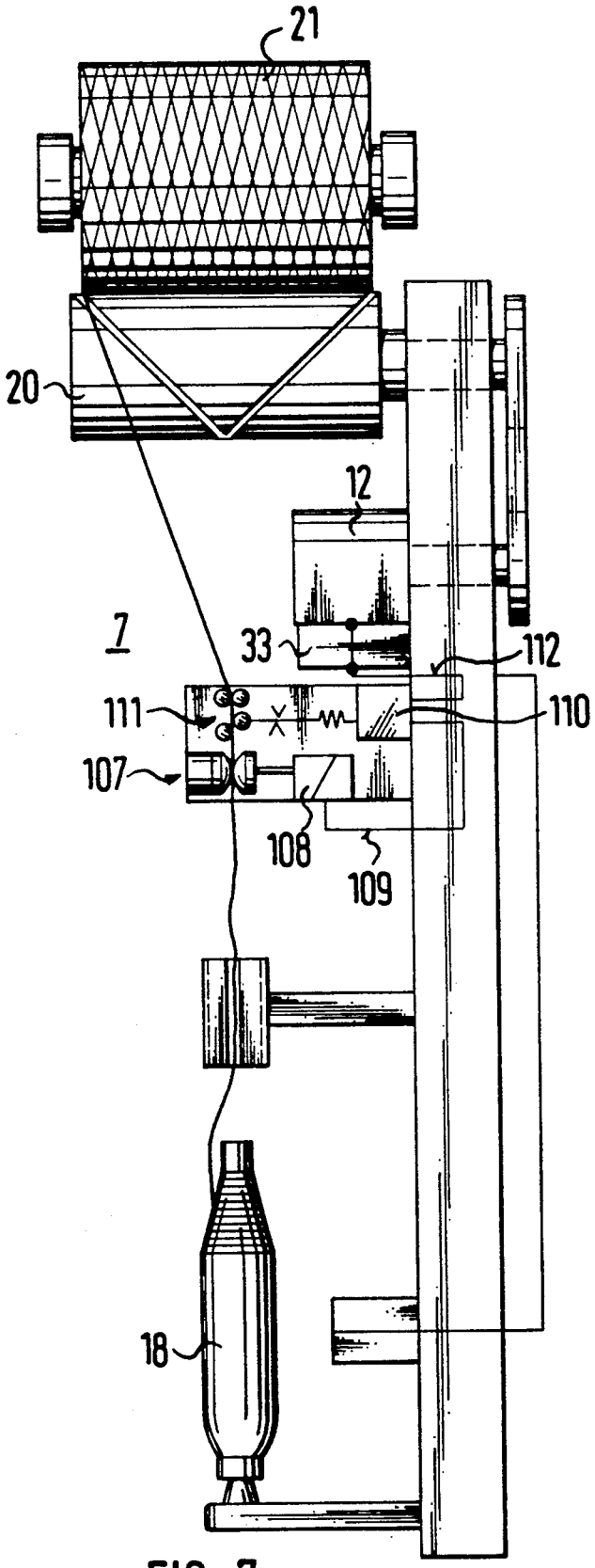
FIG. 7 is a front elevational view of the yarn amount measuring device of the method and apparatus of another preferred embodiment of the present invention.

Yet another embodiment of the present invention is illustrated in FIG. 7 and includes a yarn brake 107 having a solenoid 108 whose plunger can be moved against a compatible surface to thereby engage the yarn positioned therebetween. The yarn brake 107 is mounted to a winding station at a position to grasp the yarn traveling between a supply package 18 and a bobbin 21. The solenoid 108 is connected via a lead 109 to a yarn tension absorber 110 of a yarn tension sensor 111 positioned between the yarn brake 107 and the bobbin 21. The yarn is threaded through the yarn tension sensor 111 upstream of the yarn brake 107. The yarn brake 107 and the yarn tension sensor 111 constitute a first closed loop control system and the drive motor 12 of the winding station and the yarn tension sensor 111 constitute a second closed loop control system. A lead 112 operatively connects the yarn tension sensor 111 to a control means 33 for controlling the operation of the drive motor 12. The yarn tension sensor 111 transmits a signal via the lead 112 to the control means 33 to selectively increase or reduce the speed of the motor 12.

The operation of the yarn brake 107 and the yarn tension sensor 111 is as follows. The drive motor 12 is set to the maximum winding speed and the yarn brake 107 is set to impart a predetermined tension to the yarn passing through. The winding operation then begins and the yarn tension is sensed by the yarn tension sensor 111 of the first control system and the braking force applied by the yarn brake 107 is controlled in response to the sensed yarn tension to impart a substantially uniform tension to the yarn passing therethrough. The braking force of the yarn brake 107 is increasingly reduced as the winding operation continues until eventually the yarn brake is completely disengaged. Thereafter, as the yarn tension rises as the yarn amount on the supply package 18 drops below a certain level such as, for example, the level at which the yarn is more than two-thirds unwound therefrom, the winding speed is increasingly reduced under the control of the second control system in order to maintain the yarn tension as substantially uniform as possible. By controlling the winding operation with the first and second control systems in this manner, the winding operation is conducted at as high a speed as possible.

The embodiment in FIG. 7 includes an optoelectric sensor identical to the optoelectric sensor 106 described with respect to FIG. 6.

In a modification of one preferred embodiment of the present invention, the switch 85 can be bridged by a switch 105 which is operably connected to a yarn monitor or yarn clearer in the yarn guide unit 26. The switch 105 would thereby keep the motor 13 in circuit with the voltage source 87 even if the switch 85 were open until the yarn monitor or yarn clearer opened the switch 105. This would insure that the yarn is entirely unwound from the supply package.

In another modification of one preferred embodiment of the present invention, an optoelectric sensor 104, shown in FIG. 1, can be mounted to the controller 5 to sense the passage thereunder of the supply package 31. The optoelectric sensor 104 would thus replace the package balance 43 and would be operatively connected to the slide 59 in the previously described manner.

In FIG. 8, another embodiment of the present invention is illustrated. An automatic textile winding machine 1' includes five individual winding stations 7', 8', 9', 10' and 11'. The structure and operation of four of the winding stations 8', 9', 10' and 11' are identical to the four corresponding winding stations 8–11 described with respect to the embodiment illustrated in FIG. 1. The automatic textile winding machine 1' also includes an open top collecting member 6', disposed on the backside of the automatic winding machine 1', in which empty tubes of the packages unwound at the four winding stations 8'–11' are deposited. The collecting member 6' retains empty tubes from yarn packages which have been completely unwound at the four winding stations 8'–11' and, additionally, retains special yarn packages 18', which are yarn packages which have been incompletely unwound at the four winding station 8'–11' or have been otherwise designated as yarn packages which cannot be unwound at the winding stations.

In contrast to the winding station 7 illustrated in FIG. 1, the other winding station 7' illustrated in FIG. 8 is dedicated solely for the unwinding of the special yarn packages 18'. The winding station 7' includes a package balance 5' which is identical in construction and operation to the yarn amount measuring device 47 discussed with respect to FIGS. 4 and 5 except that the connecting bridge 70 is permanently connected to a lead 55', which is connected to the control device 34 of the winding station 7'. To determine the initial amount of yarn on the supply packages fed to the other winding stations 8'–11', a yarn amount measuring device 47 identical to the device described with regard to FIGS. 1–5 is provided and each of these other winding stations 8'–11' are individually connected by a lead to the yarn amount measuring device 47 for connection thereto by the connecting bridge 70 as discussed with respect to the embodiment illustrated in FIGS. 1–5.

The dedicated winding station 7' is continuously supplied with fresh special yarn packages from a special yarn package magazine 2'. The special yarn package magazine 2' can be stocked by hand, by an appropriate apparatus or in another conventional manner with incompletely unwound yarn packages.

A package pre-supply apparatus 47' is disposed adjacent the collecting member 6' and the dedicated winding station 7'. The package pre-supply apparatus 47' is continuously stocked with special yarn packages 18' from the collecting member 6' and can additionally be stocked with incompletely unwound yarn packages from other sources. The yarn package pre-supply apparatus 47' provides an inventory of special yarn packages to be supplied to the package magazine 2'.

In operation, each of the four winding station 8'–11' unwinds yarn from yarn packages disposed thereat and the empty tubes of the unwound yarn packages are deposited in conventional manner into the collecting member 6'. Additionally, the dedicated winding station 7' individually unwinds special yarn packages 18' disposed in its receiving area 17' and deposits the empty tubes of the special yarn packages in conventional manner into the collecting member 6'. The dedicated winding station 7' receives fresh special yarn packages 18' from the special package supply magazine 2'. Each fresh special yarn package 18' is disposed at the receiving area 17' and the yarn end of the fresh special yarn package 18' is automatically pieced in conventional manner with the yarn end of the cross-wound package 21'.

The control device 33 controls the drive motor 12' to drive the rotation of the packages 21' at the dedicated winding station 7' in accordance with predetermined winding speed control programs, two of which are graphically illustrated in FIGS. 9 and 10 in which the relationship between and among the winding speed v of the cross-wound package 21' at the dedicated winding station 7', the mass m of the special yarn package 18' and the time of winding are illustrated. In each graph, the winding speed v is plotted on the ordinate in units of meters per minute and the mass m is plotted on the lower abscissa in units of grams. The time t of the winding is plotted in units of seconds on the upper abscissa. In FIG. 9, a linear winding speed curve 45' extends from 400 meters per minute to 1,100 meters per minute. Four predetermined starting speeds I'–IV' are plotted on the winding speed curve 45' and correspond to special yarn package masses of 160, 120, 100 and 80 grams, respectively.

Assuming that the tube or bobbin of each special yarn package 18' has a mass of 40 grams, the starting speeds I'–IV' correspond to yarn weights of 120, 80, 60 and 40 grams, respectively, and the corresponding predetermined starting speeds are 1,000, 850, 775 and 700 meters per minute. To insure that each special yarn package 18' is completely unwound, the initial start time can be chosen at a point on the winding speed curve 45' corresponding to a mass less than the mass of an empty tube or bobbin of a special yarn package 18'. For example, the starting time can be set at a point corresponding to the weight of 30 grams; that is, at a weight 10 grams less than the mass of the tube of the special yarn package itself with no yarn thereon, of 40 grams. The winding time will thus continue 10 seconds beyond that point in time in which the special yarn package has been completely unwound.

In FIG. 10, a winding speed curve 46' shows the change of winding speed in a non-linear manner. Here the four predetermined starting speeds V'-VIII' correspond to special yarn package masses of 160, 120, 100 and 80 grams, respectively, and the corresponding four predetermined starting speeds V'-VIII' are 1,000, 940, 780 and a value less than 780 meters per minute, respectively.

A drive motor 12' of the winding station 7' for driving the rotation of the bobbin or cross-wound package 21' is operatively connected to the control device 33. The control device 33 controls the drive motor 12' according to a predetermined winding speed control program. Two examples of a predetermined winding speed control program are graphically illustrated in FIGS. 9 and 10.

The present invention also contemplates that a conventional opto-electronic sensor can be used in lieu of the package balance 5'.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method for controlling the tension of yarn being wound on a textile winding machine, the yarn being wound at a winding speed onto a package supported on the textile winding machine, comprising:

determining the initial amount of yarn on a supply package prior to unwinding yarn therefrom; and controlling the winding speed of the package being wound to continuously conform the winding speed to a predetermined sequence of winding speeds, said predetermined sequence of winding speeds including an initial winding speed corresponding to said determined initial amount of yarn followed by a succession of increasingly reduced winding speeds.

2. A method for controlling the tension of yarn according to claim 1 and characterized further by applying a predetermined initial tension to the yarn being wound and reducing the predetermined initial tension applied during winding in an amount substantially equivalent to the increase in tension developing in the yarn due to unwinding from a decreasing amount of yarn on the supply package to maintain a substantially uniform winding tension.

3. A method for controlling the tension of yarn according to claim 2 and characterized further in that said additional tension is applied during a first portion of winding during which the winding speed is substantially constant and reducing the winding speed during the remainder of winding to maintain a substantially constant uniform yarn tension.

4. A method for controlling the tension of yarn according to claim 1 and characterized further in that said controlling the winding speed includes controlling the winding speed of the package being wound both to continuously conform the winding speed to said predetermined sequence of winding speeds and in response to reduction in the amount of yarn on the supply package during winding.

5. A method for controlling the tension of yarn being wound onto packages supported at a winding station of a textile winding machine, comprising:

providing an inventory of packages having less than a normal amount of yarn thereon or otherwise designated as unsuitable for unwinding at a winding station;

determining the initial amount of yarn on one of the packages;

unwinding yarn from the said package and winding the unwound yarn at a winding speed onto the package supported at the winding station; and controlling the winding speed of the package being wound to continuously conform the winding speed to a predetermined sequence of winding speeds, said predetermined sequence of winding speeds including an initial winding speed corresponding to said determined initial amount of yarn followed by a succession of increasingly reduced winding speeds.

6. A method for controlling the tension of yarn according to claim 5 and characterized further in that said determining the initial amount of yarn includes gravimetric sensing of said package.

7. A method for controlling the tension of yarn according to claim 5 and characterized further in that said determining the initial amount of yarn includes determining the yarn amount by opto-electronic sensing.

8. An apparatus for controlling the tension of yarn being wound on a textile winding machine, the yarn being wound at a winding speed onto a package supported on the textile winding machine, comprising:

means for determining the initial amount of yarn on a supply package prior to unwinding yarn therefrom; and means for controlling the winding speed of the package being wound to continuously conform the winding speed to a predetermined sequence of winding speeds, said predetermined sequence of winding speeds including an initial winding speed corresponding to said determined initial amount of yarn followed by a succession of increasingly reduced winding speeds.

9. An apparatus according to claim 8 and characterized further by means for applying a predetermined initial tension to the yarn being wound and means for reducing the predetermined initial tension applied during winding in an amount substantially equivalent to the increase in tension developing in the yarn due to unwinding from a decreasing amount of yarn on the supply package to maintain a substantially uniform winding tension.

10. An apparatus according to claim 9 and characterized further in that said means for applying a predetermined initial tension is operable during a first portion of winding during which the winding speed is substantially constant and said means for reducing the predetermined initial tension is operable during the remainder of winding to maintain a substantially uniform yarn tension.

11. A textile winding machine comprising:

a plurality of winding stations for winding yarn onto packages thereat, one of said winding stations being dedicated for the winding of yarn from supply packages having less than a normal amount of yarn thereon or otherwise designated as unsuitable for winding at a winding station;

a controllable drive motor mounted at said dedicated winding station for driving the winding of yarn from unsuitable designated supply packages onto packages at said dedicated winding station;

means for collecting unsuitable designated supply packages from said winding stations for subsequent feeding of said unsuitable designated supply packages to said dedicated winding station;

means for determining the initial amount of yarn of a respective one of said unsuitable designated supply packages fed to said dedicated winding station; and means for controlling the winding speed of a package being wound at said dedicated winding station in response to the determined initial amount of yarn on said respective unsuitable designated supply package and in accordance with a predetermined variation as winding progresses, said controlling means including means for controlling said drive motor according to a predetermined winding speed control program in which the initial speed is selected in correspondence with the determined initial amount of yarn on said respective unsuitable designated supply package and in which all of the winding speeds subsequent to the initial speed are individually lower than the initial speed.

12. A textile winding machine according to claim 11, and characterized further by means for collecting unsuitable designated supply packages from said winding stations for subsequent feeding of said unsuitable designated supply packages to said dedicated winding station.

13. A textile winding machine according to claim 11, and characterized further in that said determining means includes means at said dedicated winding station for sensing the amount of yarn on said respective unsuitable designated supply package during unwinding thereof.

14. A textile winding machine according to claim 11, and characterized further by means for imparting a predetermined initial tension to the yarn being wound and means for sensing increases in tension in the yarn due to the unwinding.

15. A textile winding machine according to claim 14, and characterized further in that said imparting means includes means for imparting a winding tension to the yarn approximately equal to the winding tension of the yarn when four-fifths of the yarn has been unwound from said respective unsuitable designated supply package.

* * * * *